United States Patent [19]

Jaekle et al.

[11] 4,144,820

[45] Mar. 20, 1979

[54] RAIL CAR CLOSURE

[75] Inventors: William M. Jaekle, Morago; Robert Byrne, San Carlos; Armand Giovanelli, San Francisco, all of Calif.

[73] Assignee: Southern Pacific Transportation Company, San Francisco, Calif.

[21] Appl. No.: 810,422

[22] Filed: Jun. 27, 1977

Related U.S. Application Data

[63] Continuation-in-part of Ser. No. 737,543, Nov. 1, 1976, Pat. No. 4,116,135.

[51] Int. Cl.[2] ..... B61D 19/00; B61D 3/02; B61D 17/06

[52] U.S. Cl. ..... 105/368 R; 49/254; 105/378; 292/247; 296/56

[58] Field of Search ..... 105/368 R, 376, 378; 49/254, 394; 312/138 R, 322, 323; 292/207, 247, 248, 300, DIG. 49; 296/51, 52, 56, 106

[56] References Cited

U.S. PATENT DOCUMENTS

| | | | |
|---|---|---|---|
| Re. 28,994 | 10/1976 | Aylworth | 312/323 X |
| 2,070,347 | 2/1937 | Woodruff | 296/51 X |
| 2,711,342 | 6/1955 | Selzer | 296/51 X |
| 2,744,782 | 5/1956 | Backman | 49/254 X |
| 3,368,711 | 2/1968 | Dubo | 292/247 X |
| 3,801,177 | 4/1974 | Fylling et al. | 105/368 R X |
| 3,995,563 | 12/1976 | Blunden | 105/368 R X |
| 4,084,516 | 4/1978 | Ravani et al. | 105/368 R |

FOREIGN PATENT DOCUMENTS

| | | | |
|---|---|---|---|
| 1235309 | 5/1960 | France | 296/106 |
| 708385 | 5/1954 | United Kingdom | 292/247 |

*Primary Examiner*—Francis S. Husar
*Assistant Examiner*—Randolph A. Reese
*Attorney, Agent, or Firm*—Freilich, Hornbaker, Wasserman, Rosen & Fernandez

[57] ABSTRACT

A door designed for use in conjunction with a gate that covers the end of an enclosed rail car whose sides are sloped at the top, to cover the portion of the car end which lies between the top of the gate and the roof of the car. The top door is supported by members fastened to the roof, which permit the door to be stowed by tipping the bottom of the door outwardly and then sliding it onto the roof. The gate structure has upper ends that lie outside the lower end of the door when the gate is closed, to prevent outward tipping of the door.

4 Claims, 5 Drawing Figures

FIG. 2
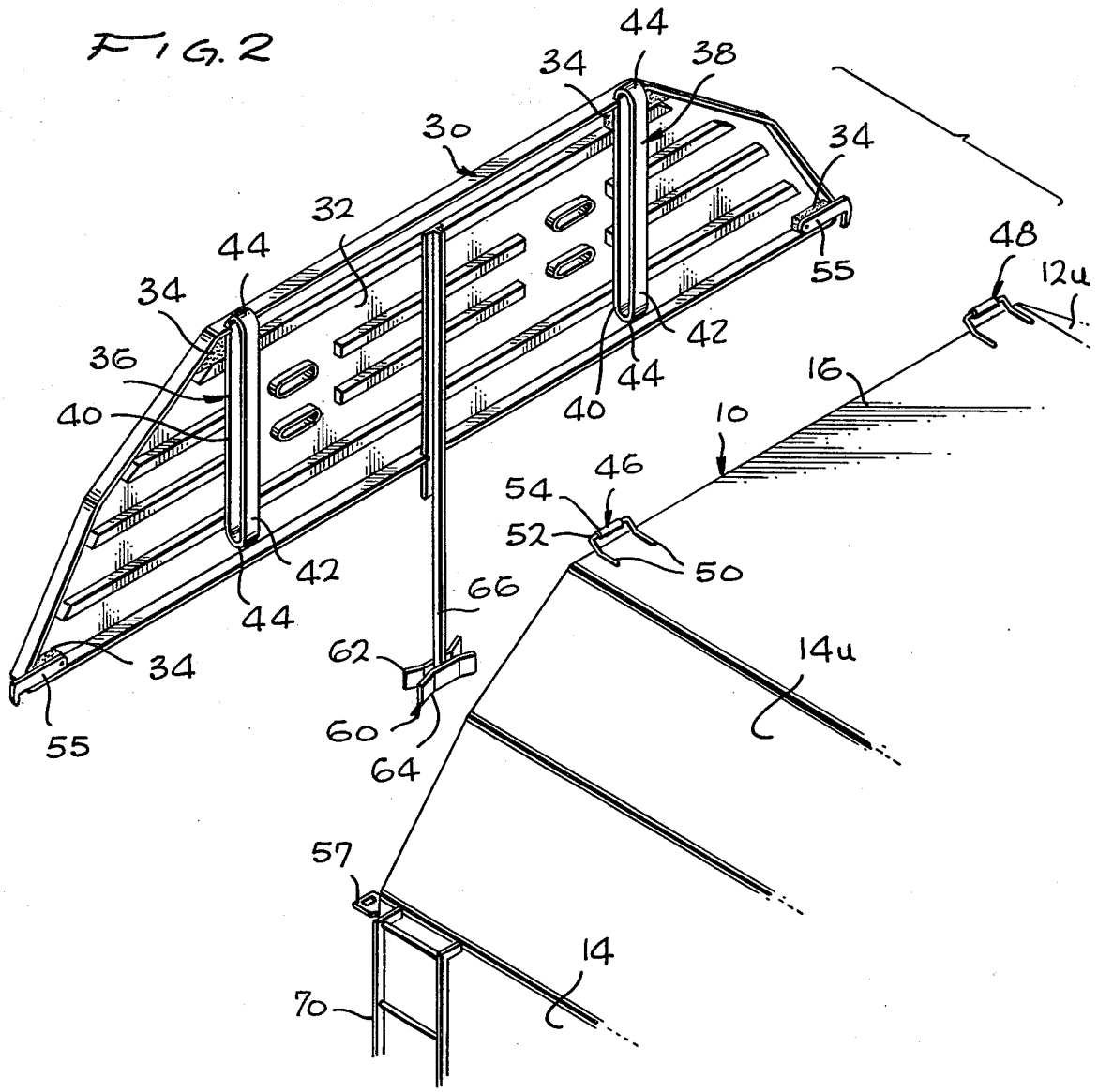
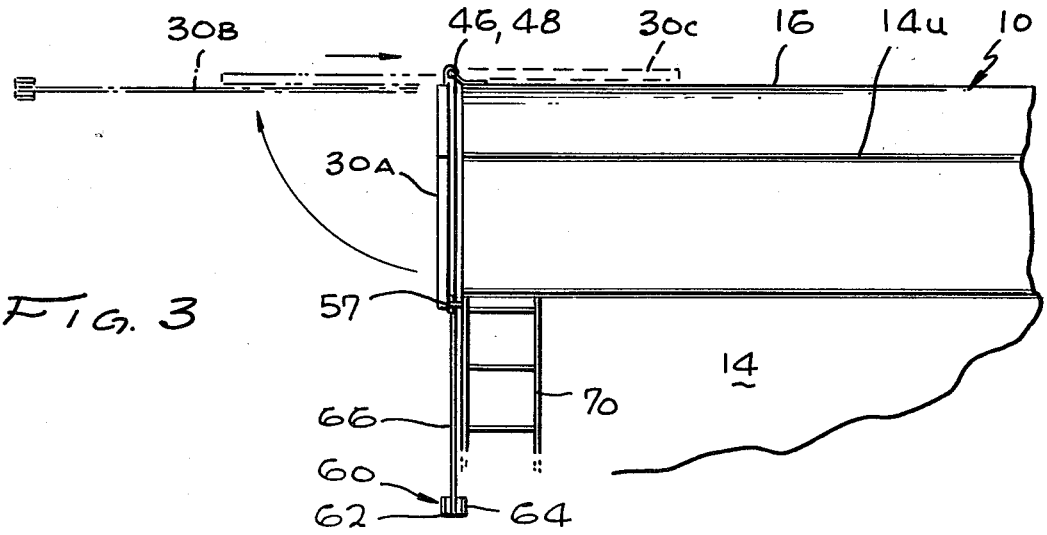
FIG. 3

RAIL CAR CLOSURE

CROSS REFERENCE TO RELATED APPLICATION

This is a continuation-in-part of patent application Ser. No. 737,543, filed Nov. 1, 1976, now U.S. Pat. No. 4,116,135, entitled "Sliding Screen Closure for Rail Cars".

BACKGROUND OF THE INVENTION

This invention relates to apparatus for closing the end of a rail car.

As described in our U.S. Pat. No. 4,116,135, it has been found necessary to cover multi-deck rail cars that carry automobiles, to prevent vandalism, especially when the rail cars are parked in rail yards. Such rail cars often have side walls that are inclined at the top where they meet the roof, and may have a sliding gate extending below the inclined portion of the side walls to enable storing at the side of the car. When the gate is closed, there is still a space of perhaps two feet high, at the top of the rail car. It has been found that this small space at the top of a rail car is sufficient for vandals to enter the rail car, and damage the automobiles therein and remove parts therefrom. Thus, a covering is required to cover the upper portion of the rail car.

SUMMARY OF THE INVENTION

In accordance with one embodiment of the present invention, a closure is provided for the end of a rail car to prevent the entry of vandals therein, and yet which can be easily opened and closed by authorized personnel. The closure includes a top door for closing the upper portion of a rail car end, in conjunction with a gate structure that can be deployed between a position at the sides of the car and a position over the end of the car. The top door has vertical rails which are slideably engaged by a pair of members fastened to the roof of the car. The door is movable from a covering position wherein it covers the upper portion of the rail car end, to a stowed position on top of the car roof, by first tipping the door outwardly away from the car end and then sliding the door onto the roof. The gate is constructed so that a portion lies outside the bottom of the door when the gate is closed, to prevent the door from being tipped outwardly.

The novel features of the invention are set forth with particularity in the appended claims. The invention will best be understood from the following description when read in conjunction with the accompanying drawings.

BRIEF DESCRIPTION OF THE DRAWINGS

FIG. 2 is an exploded rear perspective view of the upper portion of the structure of FIG. 1;

FIG. 3 is a view taken on the line 3—3 of FIG. 1, but showing the door as it is being moved to a deployed position;

DESCRIPTION OF THE PREFERRED EMBODIMENT

Figure 1:
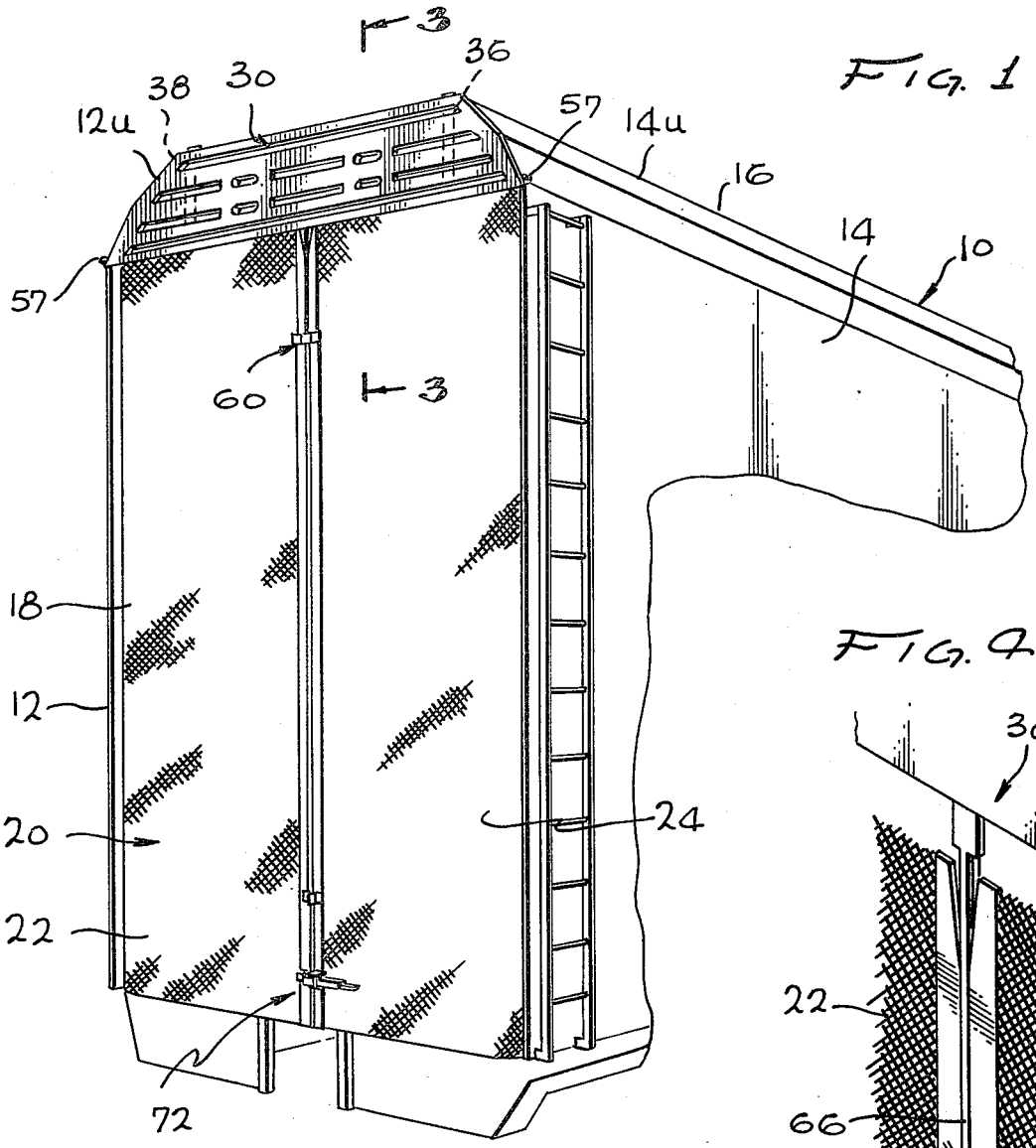
FIG. 1 is a partial perspective view of a rail car shown with the end gate structure and top door in closed positions.

FIG. 1 illustrates a rail car 10 of a type designed to carry new automobiles. The car includes closed sides 12, 14 and a close roof 16 for protecting the automobiles. The ends, such as 18, of the car are open to permit the entrance and exit of automobiles. A gate structure 20 is provided to close the end 18 of the car after the automobiles have been loaded thereon, to safeguard against unauthorized entry and to protect the automobiles from rocks and the like that may be thrown at them. The gate structure 20 includes two gates 22, 24 which can be stowed at the sides 12, 14 of the rail car, as described in our earlier patent application. However, each side of the car has a sloped upper end portion 12*u*, 14*u* which begins about two feet below the roof 16, so that the tops of the gates 22, 24 lie about two feet below the roof. It has been found that vandals will climb through the opening over the gates, to enter the rail car and vandalize the automobiles therein.

In accordance with the present invention, a top cover or door 30 is provided to cover the portion of the rail car end which lies over the gates 22, 24. The door 30 comprises a sheet of fiberglass 32 (FIG. 2) with several wood mounting blocks 34 laminated to the inward face of the door which faces the rail car. A pair of guide tracks 36, 38 are fastened to the mounting blocks 34 at either side of the door, each track having two vertically extending runners 40, 42 and the upper ends of the runners connected together by a loop portion 44 of the track. These guide tracks 36, 38 are held to the rail car by a pair of substantially U-shaped holders 46, 48 fastened to the roof 16 of the rail car. Each holder includes a pair of legs 50 welded to the roof, and a cross arm 52 extending beyond the edge of the roof and rotatively supporting a cylinder 54. The door 30 is supported on the holders by the runners 40, 42 of each guide track on the door being received between the cross arm 52 of a corresponding holder. A pair of side hooks 55 are pivotally mounted on either side of the door, to engage a pair of catches 57 on the rail car to minimize rattling of the door.

The door is utilized by hanging it in the position 30A (FIG. 3) wherein it depends from the holders 46, 48 and covers the upper portion of the rail car end. In order to completely open the end of the car, the lower end of the door can be swung outwardly until the door is in the position 30B, and then the door can be slid inwardly to the position 30C wherein it rests on the roof 16 of the rail car. In order to prevent a vandal from swinging out the door, the door is provided with a gate engager 60 at its lower end for engaging the leading portion of the gates, so that when the gates are closed a portion of the gate engager lies behind the gate and prevents the door from being swung out.

Figure 4:
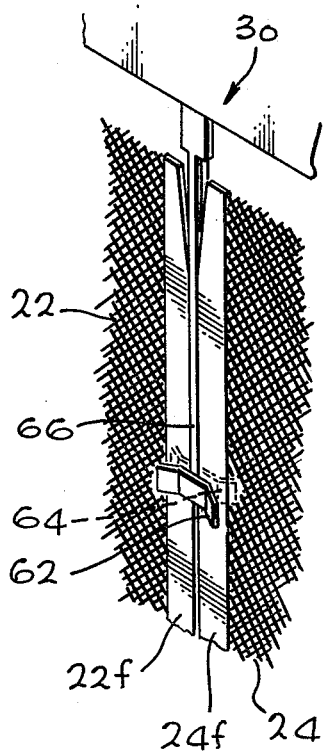
FIG. 4 is a partial front perspective view of the structure of FIG. 1.

FIG. 4 illustrates details of the gate engager 60 which includes a pair of gate guides 62, 64 on either side of a central portion 66. Each gate 22, 24 includes a leading frame member 22*f*, 24*f* that lies at the leading end of the gate, and with the two frame members adjacent to one another when the gate structure is closed. Each pair of gate guides 62, 64 is positioned to receive a corresponding gate frame member 22*f*, 24*f* to firmly hold the bottom of the door to the gates. This helps avoid rattling of the door, and also prevents upward pivoting of the door since the inward gate guides 64 on the door cannot be moved outwardly when the gate structure is closed with the frame members 22f, 24f lying in front of them.

One door 30 constructed for a rail car in accordance with the invention has a height H (FIG. 2) of about 26 inches and is constructed of plastic, so that it is light enough to be easily stowed onto the roof of the rail car. A workman can climb up a ladder 70 (FIG. 1) at the side of the rail car to the roof thereof, or just to the level of the highest deck in the car and then tilt back the door to duck under it and onto the deck, to pivot up the door and pull it back onto the roof.

Figure 5:
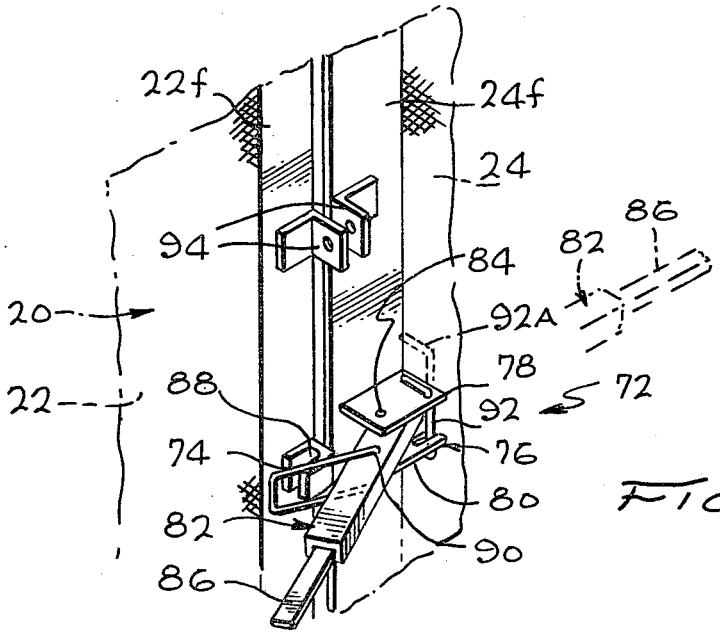
FIG. 5 is a perspective view of a gate latching mechanism of the structure of FIG. 1.

The locking of the door in place is completed by locking the leading frame members of the gate together, which is accomplished by a locking device 72 (FIG. 1) located near the bottom of the gate structure. As illustrated in FIG. 5, the locking device includes a hook-like catch 74 attached to one of the frame members 22f. A mount 76, attached to the other frame member 24f, includes upper and lower flanges 78, 80. A locking bar 82 has an inner end pivotally mounted at 84 on the mount flanges, and an outer end 86 which forms a handle. A lock arm 88 is pivotally mounted on the arm 82 at a location 90 between the opposite ends of the bar. When the locking bar 82 is pivoted towards the catch 74, the lock arm 88 can engage the catch 74. When the bar 82 is pivoted away from the catch, the arm 88 pulls the catch to pull the gate frame members 22f, 24f together. A retaining rod 92 on the flange mount 76 can be lifted up to the position 92A to allow the locking bar 82 to be pivoted inside the retaining rod so that when the retaining rod is dropped it locks the bar closed. A padlock can then be utilized to fasten a pair of lock flanges 94 together.

Thus, the invention provides a door for covering an end of a rail car in conjunction with a slideable gate that is storable at the rail car sides, wherein the door can be easily locked in position or stowed. This is accomplished by utilizing a door with vertical guides supported by holders on the roof, wherein the door can be stowed by first pivoting the bottom of the door outwardly. In addition, the door is constructed so that a portion of it lies behind the gate when the gate is closed, so that the closed gate prevents opening of the door.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a rail car which includes a closed roof, sides that slope towards each other at their upper ends, and tall ends, the improvement comprising:

a gate structure closeable over most of one end of said rail car, and openable away therefrom, said gate structure sidewardly moveable and storeable at at least one side of the car below the slope in the car side;

a top door having sides sloping to conform to the sloped upper ends of said car sides;

holding means for supporting said door over the upper part of said car end, said door being moveable onto said roof by first tipping the lower end thereof outwardly and up and then sliding it along said holding means onto said roof;

said gate structure including a portion moveable to a position directly outside a lower portion of said door, to prevent outward tipping of said door when said gate structure lies over said rail car end.

2. The improvement described in claim 1 wherein:

said holding means includes a pair of substantially U-shaped holders at opposite sides of the rail car roof, each including a pair of legs fastened to said roof of said rail car and a base spaced from the rear edge of the roof;

said door includes a cover sheet extending over the upper portion of the rail car end, and a pair of elongated vertical guide tracks fixed at opposite sides of the inner surface of said cover sheet, each vertical track having two vertically-extending runners, one spaced inwardly from the other, and the tops of said parts joined together; and each vertical guide track receives the cross arm of a corresponding holder between the vertically-extending runners of the vertical guide track.

3. In a rail car having sides, a roof, and at least one open end with said sides having upper ends sloping towards each other, the combination with said rail car of means for closing said open end comprising:

a gate structure which includes a pair of gates storable at either side of the rail car, each gate having a vertical leading frame member which can move to near the middle of the open car end, each gate extending up to a level below the car roof;

a top door including a cover sheet for covering an upper portion of the car open end and a pair of vertical guide tracks, each guide track having a pair of spaced vertical runners joined at their tops; and a pair of substantially U-shaped holders on opposite sides of the roof of the rail car, with the legs of each U-shaped holder fastened to the roof, and the base of the U holder received between the pair of vertical runners of the corresponding vertical guide track, so that the door can be stowed on the roof by tipping it horizontally and then sliding it onto the roof;

said door having gate guides at the bottom of the door, which lie behind said gates, to thereby prevent outward tipping of the door when the gate is closed.

4. In a rail car which includes a closed roof and sides, the improvement comprising:

a gate structure closeable over most of one end of said rail car and openable away therefrom, said gate structure including two gate sections each having a leading frame member slideable from a side of said car end to near the middle thereof;

a top door; and holding means for supporting said door over the upper part of said car end, said door being movable onto said roof by first tipping the lower end thereof outwardly and up and then sliding it along said holding means onto said roof;

said door having a gate engager at the lower end thereof, said engager having a pair of spaced gate guides on either side thereof, each pair of gate guides positioned to receive a corresponding leading frame member between them, whereby to prevent outward tilting of the door when the gate structure is closed.

* * * * *